US007895674B2

(12) United States Patent
Miller

(10) Patent No.: US 7,895,674 B2
(45) Date of Patent: Mar. 1, 2011

(54) BELT

(76) Inventor: Edward A. Miller, Laguna Woods, CA (US)

( * ) Notice: Subject to any disclaimer, the term of this patent is extended or adjusted under 35 U.S.C. 154(b) by 334 days.

(21) Appl. No.: 11/701,819

(22) Filed: Feb. 2, 2007

(65) Prior Publication Data

US 2008/0104741 A1 May 8, 2008

Related U.S. Application Data

(60) Provisional application No. 60/856,645, filed on Nov. 3, 2006.

(51) Int. Cl.
*A41F 9/00* (2006.01)

(52) U.S. Cl. ..... 2/338

(58) Field of Classification Search ..... 2/219, 2/221, 235, 237, 311, 312, 315, 316, 317, 2/318, 319, 321, 322, 323, 338, 339, 335, 2/340

See application file for complete search history.

(56) References Cited

U.S. PATENT DOCUMENTS

| | | | | | |
|---|---|---|---|---|---|
| 6,786 | A | * | 10/1849 | Goodyear | 87/2 |
| 230,289 | A | * | 7/1880 | Laffite | 2/330 |
| 230,532 | A | * | 7/1880 | Day | 2/333 |
| 578,294 | A | * | 3/1897 | Leavitt | 2/229 |
| 581,884 | A | * | 5/1897 | Gourley | 2/312 |
| 582,737 | A | * | 5/1897 | Hammond | 2/319 |
| 809,074 | A | | 1/1906 | Niles | |
| 822,076 | A | * | 5/1906 | Rhodes | 2/319 |
| 868,584 | A | * | 10/1907 | Sharp | 2/333 |
| 949,827 | A | * | 2/1910 | Kurtz | 2/233 |
| 957,117 | A | * | 5/1910 | Snow | 2/310 |
| 966,093 | A | | 8/1910 | Hilgert | |
| 1,039,995 | A | | 10/1912 | Niles | |
| 1,059,603 | A | * | 4/1913 | Fritz | 2/304 |
| 1,084,565 | A | | 1/1914 | Simmons | |
| 1,216,991 | A | * | 2/1917 | Hausen | 2/335 |
| 1,233,958 | A | | 7/1917 | Baker | |
| 1,246,684 | A | | 11/1917 | Turnage | |
| 1,255,717 | A | * | 2/1918 | D'ostroph | 2/333 |
| 1,272,754 | A | | 7/1918 | Woods | |
| 1,294,374 | A | | 2/1919 | Arons | |
| 1,297,158 | A | | 3/1919 | Hawkins, Jr. | |
| 1,307,503 | A | | 6/1919 | Leak | |
| 1,402,899 | A | * | 1/1922 | Scott | 267/69 |
| 1,464,744 | A | | 8/1923 | Bowe | |

(Continued)

*Primary Examiner*—Alissa L Hoey
(74) *Attorney, Agent, or Firm*—Stetina Brunda Garred & Brucker; Lowell Anderson

(57) ABSTRACT

A belt and garment fasten around a user's waist to support the garment at a selected waistline position. The belt has first and second arches with each arch having a front end a rear end fastened to the belt. The front end of each arch is located so it fastens to the belt adjacent the user's crotch during use. The rear end of each arch is located so it fastens to the belt at or before the hips of the user during use. Two first fasteners are connected to each of the arches adjacent a top of the arch. The garment has two second fasteners connected to a waistband of the garment. The second fasteners are located to releasably engage the first fasteners to fasten the arch to the garment so the arches hold the waistline of the garment above the belt. The garment covers the belt and arches. The garment is optionally connected to the belt by a third fastener located between the arches, along the user's back.

29 Claims, 6 Drawing Sheets

U.S. PATENT DOCUMENTS 1,492,872 A * 5/1924 Wade ..... 2/302
1,513,522 A * 10/1924 Ross ..... 2/337
1,794,681 A * 3/1931 Gelow ..... 2/326
1,939,327 A * 12/1933 Vanace ..... 2/117
1,992,741 A * 2/1935 Donaldson ..... 2/331
2,001,629 A * 5/1935 Quasso ..... 24/342.1
2,018,981 A * 10/1935 Tietjen ..... 128/96.1
2,036,674 A * 4/1936 Bartlog ..... 2/302
2,128,583 A * 8/1938 Goodrich ..... 2/323
2,181,192 A * 11/1939 Liebmann ..... 2/117
2,245,556 A * 6/1941 Ellison ..... 2/332
2,443,802 A * 6/1948 Pruden ..... 2/314
2,505,383 A 4/1950 Brunson
2,705,328 A 4/1955 Felix
2,707,285 A * 5/1955 Tino ..... 2/330
2,765,470 A 10/1956 Read
2,946,064 A 7/1960 Dieterle
3,295,501 A * 1/1967 Riley ..... 119/770
3,940,801 A * 3/1976 Riggs et al. ..... 2/311
4,118,804 A * 10/1978 Freese ..... 2/340
4,139,130 A * 2/1979 Glusker et al. ..... 224/148.2
4,413,358 A * 11/1983 Jimenez ..... 2/321
4,498,201 A 2/1985 Carter
4,800,594 A * 1/1989 Young ..... 2/237
5,065,773 A * 11/1991 Jackson et al. ..... 482/106
5,152,013 A * 10/1992 Johnson ..... 2/321
5,172,429 A * 12/1992 Lucier ..... 2/326
5,313,669 A * 5/1994 Rasdell et al. ..... 2/323
5,373,587 A * 12/1994 Sexton ..... 2/237
5,488,738 A * 2/1996 Seamans ..... 2/69
6,070,434 A * 6/2000 Traver ..... 63/1.11
6,098,202 A * 8/2000 Peck ..... 2/244
6,125,792 A * 10/2000 Gee ..... 119/770
6,286,152 B1 * 9/2001 Mooneyhan et al. ..... 2/266
6,308,338 B1 * 10/2001 Caldwell ..... 2/312
6,389,605 B2 * 5/2002 Srivastava ..... 2/312
6,436,011 B1 * 8/2002 Cook ..... 482/69
6,526,597 B1 * 3/2003 Shepard ..... 2/255
2004/0187194 A1 * 9/2004 Gilliam ..... 2/340
2006/0213036 A1 * 9/2006 Flowers et al. ..... 24/72.1
2007/0006367 A1 * 1/2007 Newman et al. ..... 2/338
2008/0172769 A1 * 7/2008 Herget ..... 2/76

* cited by examiner

BELT

CROSS-REFERENCE TO RELATED APPLICATIONS

This application claims the benefit under 35 U.S.C. §119 (e) of application Ser. No. 60/856,645 filed Nov. 3, 2006, the complete contents of which are incorporated herein by reference.

BACKGROUND

A person with a discernable paunch or stomach typically pulls a belt tight in order to maintain a level waistline on the person's pants, skirt or garment. That is very uncomfortable, especially when the user bends over. Some persons with extending stomachs will allow the stomach to protrude over the belt, so the waistline curves downward toward the person's crotch, and that presents an unattractive appearance. There is thus a need for a garment that maintains a level waistline even if the user has a pronounced stomach, while allowing the user to move freely and without squeezing the person's stomach.

Some dress styles allow the waistline of a person's pants to ride very low on the waist so it looks like the pants are falling off—which they are. In such cases the user continually repositions the pants to maintain them in a low-ridding position without allowing the pants to fall onto the user's legs. There is a need to position a waistline at a desired position and to maintain that waistline position without repeated manual adjustment.

BRIEF SUMMARY

A belt and garment fasten around a user's waist with the belt being configured to support the waistline of the garment at a selected waistline position. The belt has first and second arches with each arch having a front end a rear end fastened to the belt. The front end of each arch is located so it fastens to the belt adjacent the user's crotch during use. The rear end of each arch is located so it fastens to the belt at or before the hips of the user during use. Two first fasteners are connected to a different one of the arches adjacent a top of the arch. The garment has two second fasteners, preferably but optionally connected to a waistband of the garment. Each of the second fasteners is located to releasably engage one of the first fasteners to fasten the arch to the garment so the arches hold the waistline of the garment above the belt. The garment preferably covers the belt and arches, so the belt is inside the garment. The garment is optionally connected to the belt by a third fastener located between the arches, along the user's back. More than one fastener could be located along the user's back to connect the belt to the garment. The garment can fasten to the arches using a single fastener, or by using two or more fasteners.

Preferably, but optionally, each arch is made of flexible material and designed to flex and enable the arch to conform to the general body shape. Advantageously, each arch is not symmetric, but is inclined toward the other arch so the top of each arch is fairly flat so the arch can be fastened to the horizontal waistband of a garment. Moreover, each arch can be doubly curved to conform to the general shape of an extending stomach. Optionally, each arch is permanently fastened to the garment, although the arches are preferably releasably fastened to the garment. Optionally, each arch is permanently fastened to the belt, although the arches are preferably releasably fastened to the belt. Preferably, but optionally, the front and back ends of the arch are stiffer than the portion of the arch between those front and back ends There is also provided an improved belt to be worn underneath a garment, the belt having opposing distal ends. The belt further has first and second arches each having a front end a rear end fastened to the belt. The front end of each arch is fastened adjacent a different end of the belt. The front end of each arch is located so it fastens to the belt adjacent the user's crotch during use. The rear end of each arch is located so it fastens to the belt at or before the hips of the user during use. At least two first fasteners are each connected to a different one of the arches between the front and rear ends and adjacent a top of the arch.

Each arch is preferably not symmetric, but is inclined toward the other arch. Moreover, each arch is doubly curved to conform to the general shape of an extending stomach. Further, there are preferably, but optionally two first fasteners on each arch with the fasteners located on a generally level line. Optionally, the arches are permanently fastened to a garment. Optionally, the arches are permanently fastened to the belt. Preferably, the front and back ends of the arch are stiffer than the portion of the arch between those front and back ends. The fasteners are preferably releasable fasteners so the arch is releasably fastened to the garment, to the belt, or to both the garment and the belt.

There is also advantageously provided a garment having a waistband for use with a belt support, where the belt support has two arches that extend from the belt to the waistband. The garment has at least two fasteners connected to the garment adjacent the waistline of the garment and on the waistband. Each of the at least two fasteners is located to engage a different one of the arches. The garment also has an optional third fastener located between the two fasteners and further located to be on the back of the user during use. The third fastener can include more than one fastener.

Preferably, but optionally, there are two fasteners on each arch and two second fasteners on the garment, with all of these fasteners located on a generally level line. Preferably the fasteners on the garment are releasable fasteners, although optimally the garment could be permanently connected to the arches.

There is also advantageously provided a method of supporting a garment worn around a user's waist. The garment has a waistband with a waistline and the user has an extending stomach with thighs and hips and with a crotch between the thighs and hips. The method includes placing a belt along the juncture of the stomach and thighs where the belt has two arches located on opposing sides of the crotch with each arch having a front end adjacent the crotch and a rear end adjacent and in front of the hips. The method further includes supporting the waistline at a selected position by fastening the garment to the arches to cover the arches and belt where the arches are sized and positioned to support the waistline at the selected position.

In further variations, the method also includes supporting the waistline by fastening the garment to the belt at a location between the hips and along a back of the user. Further variations also include fastening the garment to each arch at two locations. Further, the method can include fastening at least one button to each arch where the button is sized slightly smaller than a width of the waistband and then placing the butting through a slit on the inside of the waistband where the slit extends along a length of the waistband. Advantageously, the slit is formed in a piece of material that is then sewn to or clipped to the waistband.

In still further variations, the method can optionally include permanently fastening the arches to the belt, or permanently fastening the arches to the garment, or both, although preferably they are all releasably fastened together.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
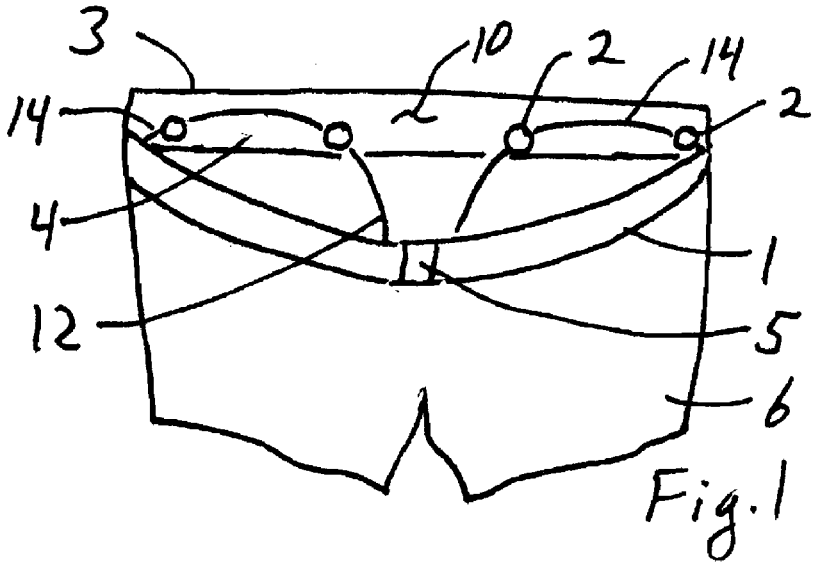
FIG. 1 is a front plan view of a preferred embodiment of a belt with arches that are attached to a garment.

FIGS. 1-5 and 7 show a flexible belt 1 with a connector 5, such as a belt buckle. The belt 1 is placed along the natural curves of a person's body between the stomach and the upper thighs and buttock. This natural curvature becomes more pronounced as the stomach enlarges. This belt is for use by persons having a noticeable stomach, persons who typically, if they tighten their belt will compress their stomach to an uncomfortable degree. Thus, there is typically a discernable or even a pronounced curvature between such a person's thighs and stomach, and the belt fits into the area of this curvature. The belt 1 is fastened so it does not constrict the overhanging stomach at the waistline 3 of the garment 6. The belt 1 optionally has one or more buttons, snaps, toggles, hooks, hook-and-loop connections, belt and loop connection, or other types of fasteners 2 along the part of the belt that abuts the wearer's back.

A flexible arch 4 is fastened so it extends above the top edge of the belt 1 a distance sufficient to reach the waistband 10 adjacent the waistline 3 of the user's garment 6 (pants, skirt, etc.) A fastener 2 is also located at the top of each offsetting arch 4. The height of the arch 4 will vary, but can be approximated as a function of a person's waist size and pant or leg length. The offsetting arch 4 is flexible. A thin metal rod or wire is preferred for the arch, but suitably strong plastics may be used. The arch could be formed from a continuous flexible loop, but the arch is preferred that has two distal end with each end of the arch fastened to the belt 1. Two offsetting arches 4 are provided, located on the belt 1 adjacent to each side of the zipper or center of the garment 6.

Figure 5:
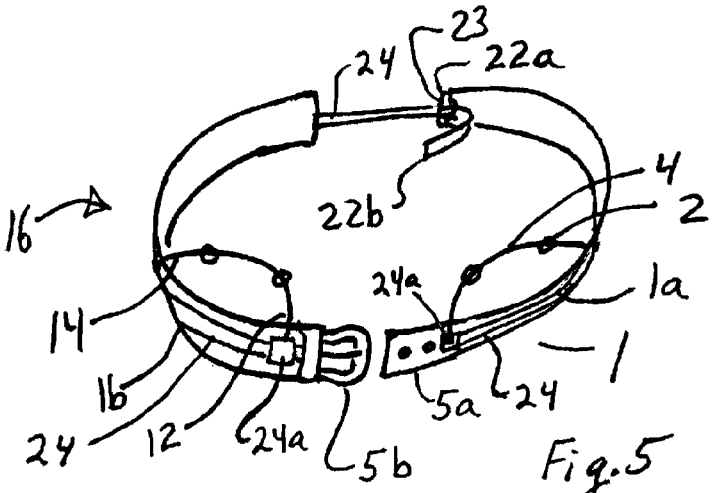
FIG. 5 is a perspective view of a belt with an adjustable back portion, apart from a garment, with two fasteners on an each arch and with the arches fastened to an outside of the belt.
Figure 6:
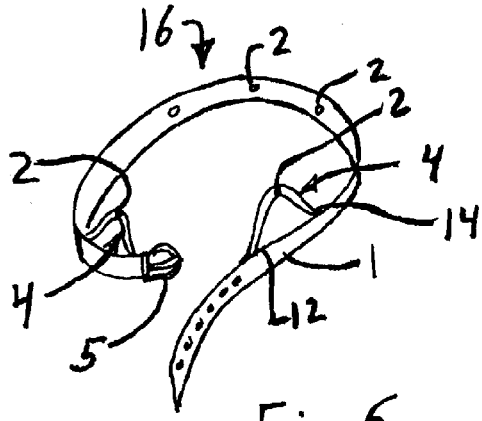
FIG. 6 is a perspective view of a belt with a non-adjustable back portion, apart from a garment and with one fastener on each arch, with the arches fastened to an inside of the belt.

In use, the fasteners 2 are connected to the inside of the back of the garment 6 (pants, skirt, etc,) by using a mating fastener, such as a mating buttonhole, mating snap, toggle loop, hooks, clamps such as those used in suspenders (FIG. 16), and other releasable fasteners now known. Preferably, the fasteners 2 are concealed from view by others, so external viewable clamps are not preferred. The arch 4 is also fastened to the inside of the garment, preferably using a releasable fastener 2, which is also preferably (but optionally) concealed from view by others. FIGS. 5-6 show one fastener 2 for each arch, while FIG. 1 shows two fasteners for each arch. Two fasteners are preferred, and more than two fasteners could be used for each arch, but less preferably. The belt 1 fits comfortably inside the garment 6 and supports the waistband 10 and waistline 3 of the garment 6 at the normal level by the fasteners 2 and arch 4, but without having to squeeze the stomach at the waistline 3 of the garment 6. The garment is held at its normal position around a person's waist internally by the belt 1 and arches 4, while the belt 1 is worn comfortably along the naturally formed body lines, without squeezing the stomach at the waistline 3 of the garment 6. In a sense, the bottom of the belt 1 rests against naturally occurring curves or creases in the body at the juncture of the thighs and stomach in order to support the garment internally, with the arches 4 provided to support the offset of the waistline 3 from the belt 1. The flexible arch 4 also allows deformation as a person sits down or bends over without pressing into the stomach.

Figure 7:
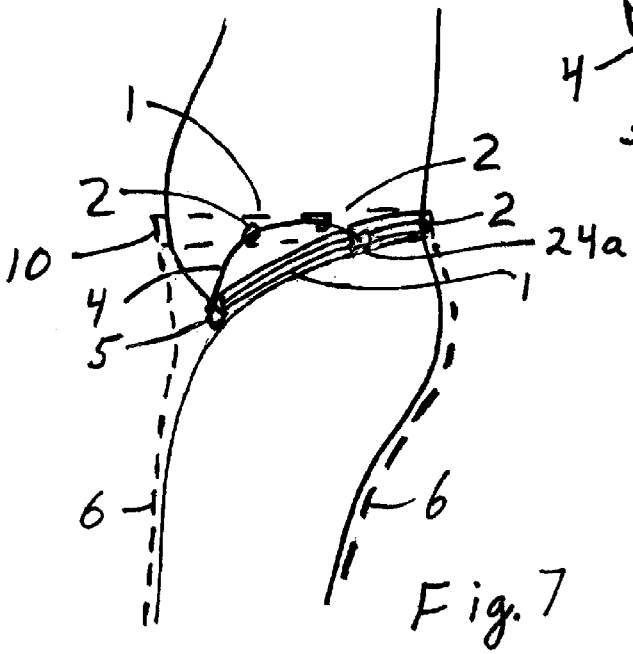
FIG. 7 is a side view of the belt of FIG. 1 on a person.

As used herein, the forward direction is the direction a person looks when looking straight forward. The rear direction is opposite, toward a person's back. Referring to FIGS. 1 and 7, the arch 4 has opposing ends fastened to the belt 1. The arch 4 preferably fastens to the outside of the belt but could fasten to the inside of the belt and that orientation is used in some of the Figures for ease of illustration. Outside refers to the side most distant from the user's body.

A front end 12 of the arch fastens to the belt 1 adjacent a person's crotch, near the zipper (if present) or the midline of a person's body. Advantageously the front end 12 fastens to the belt 1 at or near the lowest point below the user's stomach to provide a stable support. A rear end 14 of the arch 4 attaches to the belt adjacent a person's hip, preferably on the hip or slightly in front or behind the hip, which also provides a stable support. The arch 4 is usually straighter as it approaches the front end 12 because the belt 1 is further offset from the waistline 3. The arch 4 is usually more inclined as it approaches the rear end 14 because the waistline 3 is not offset from the belt as much. The arch 4 connects the garment 6 to the inside belt 1.

Figure 2:
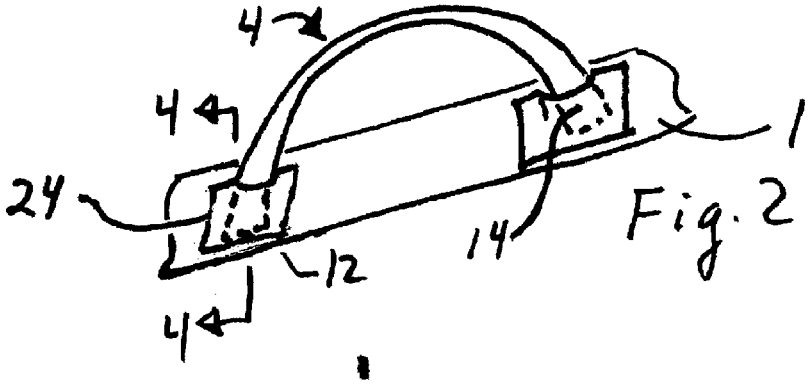
FIG. 2 is a front plan view of an arch used on the belt of FIG. 1.
Figure 4:
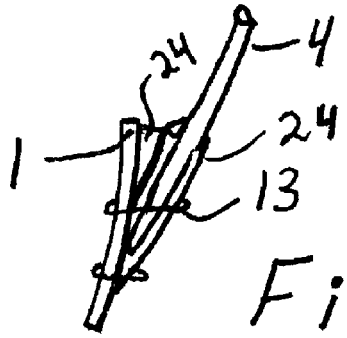
FIG. 4 is a partial sectional view taken along 4-4 of FIG. 2, showing the end of one arch attached to the belt.
Figure 17:
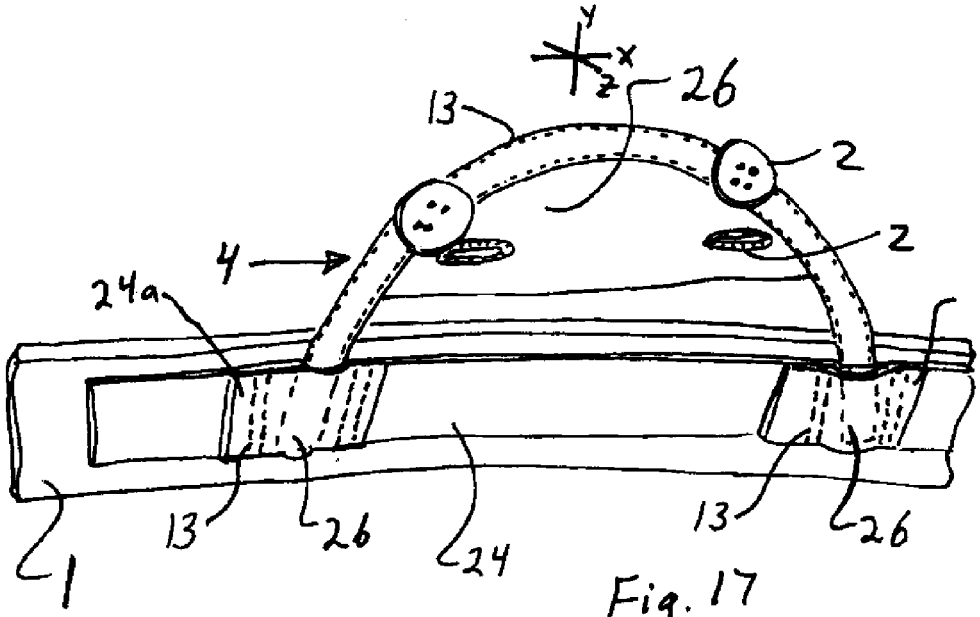
FIG. 17 is a partial perspective view showing an outside view of an arch connected to a belt, with an alternative fastening mechanism.

Referring to FIGS. 1, 2 and 17, the front end 12 of the arch 4 is preferably, but optionally attached to the belt 1 using a rotatable or hinged connection which allows the front end 12 to rotate forward as a person bends forward. If the belt 1 is flexible, the front end 12 could be fastened directly to the belt by stitches, rivets, etc., and could be fastened adjacent a top and bottom of the belt. Stitches 13 are shown in FIGS. 4 and 17. If the belt 1 is stiff then the front end 12 could be fastened to the belt at a single point about which the front end 12 could rotate forward and backward. Further, the front end 12 could be formed with a hinged or narrower or weaker section in either the width or thickness of the arch, or both, in order to allow greater flexibility and bending when a person's stomach pushes forward on the arch 4. Given the present disclosure, a person skilled in the clothing and apparel art could devise other ways to rotatably fasten the front end 12 to the belt to allow rotation. The rear end 14 is fastened like the front end 12, but could be more stiffly fastened as it does not usually need to rotate as much as the front end 12. Rigid fastening of the arch 4 to a stiff belt 1 is possible, but less desirable since it may not be as comfortable to the user.

In addition to allowing some rotation of the arch 4, the fastener 2 connecting the belt 1 to the arch 4 also optionally accommodates forward and backward motion to allow easy expansion and contraction of the stomach as a user breathes or bends over or bends backward or twists etc. Thus, rigid connections are not desirable, while flexible connections are desirable.

The front and rear ends 12, 14 of the arch 4 are preferably, but optionally, stiffer than the middle portion of the arch. This can be achieved by changing the width or thickness of the arch. Advantageously the arch is formed of metal covered with fabric. The arch could be integrally molded of a plastic material such as polyethylene or polypropylene to help achieve this different flexibility, but this is not as desirable unless the plastic is strong. The more flexible center of the arch allows the top of the arch to flex downward as a person leans forward and reduces the pressure the arch exerts against the user's stomach as the user leans forward. The arch 4 is thus preferably designed to be flexible in all directions except it is stiff enough in the vertical direction to maintain the waistline 3 in the desired position.

Figure 8:
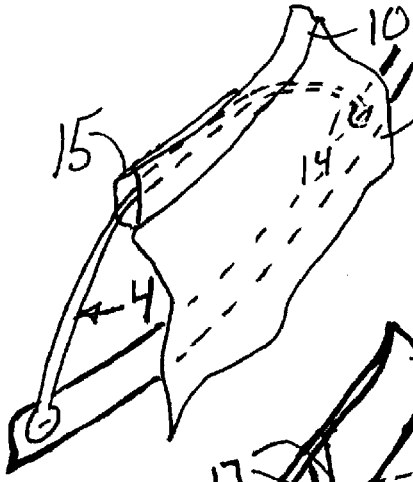
FIG. 8 is a perspective view of an arch in a pocket fastened to a waistband of a garment.
Figure 9:
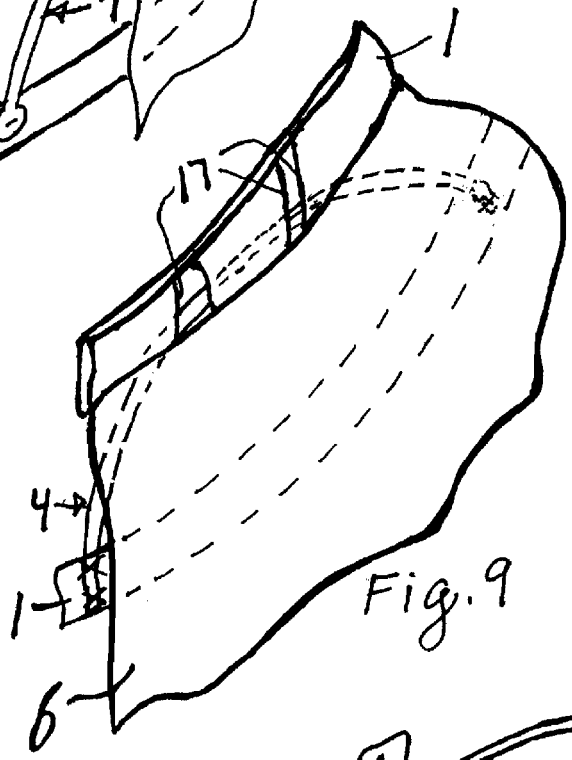
FIG. 9 is a perspective view of an arch passing through slits in a waistband of a garment.
Figure 10:
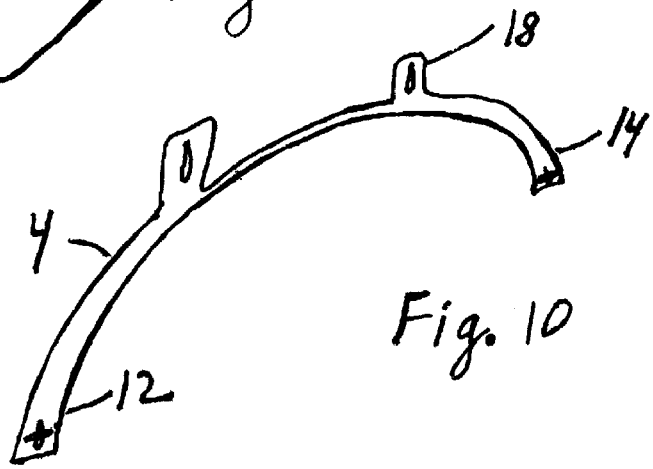
FIG. 10 is a view of an arch having tabs for connecting to a garment.
Figure 16:
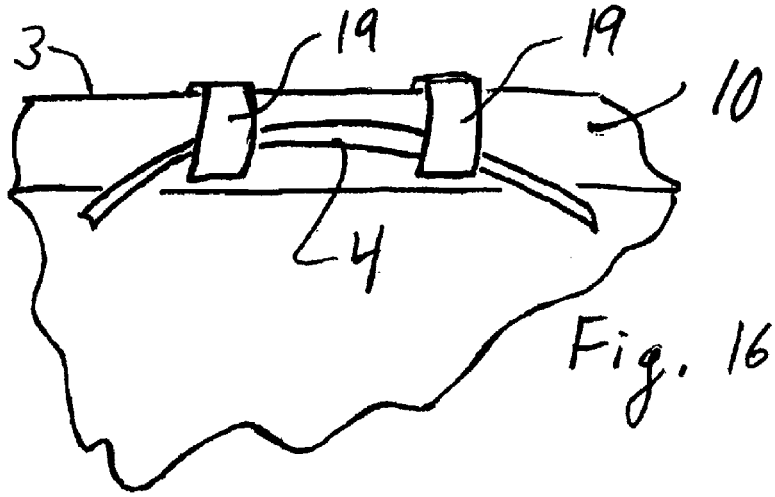
FIG. 16 is a partial perspective view of clamps fastening an arch to the belt at two locations.

Referring to FIGS. 1 and 7, the arch 4 is fastened to the waistband 10 of the garment 6 at two locations along a generally horizontal line, although the exact locations can vary. The connection is achieved by fasteners 2 located on the waistband 10 and arch 4, and preferably, but optionally, the fasteners on the waistband are located on the inside of the garment 6 and the inside of the waistband. Buttons or snaps fastened to the arch 4 could be used. Alternatively, referring to FIG. 8, the arch 4 could pass through a tubular pocket at the waistband much like a stay in the collar of a shirt. Further, as seen in FIG. 9, the arch 4 could pass through a pair of slits 17 in the waistband, or a loop in the waistband. The slits 17 are shown as visible on the outside of the garment 6, or they could be viewed only from the inside of the garment. Referring to FIG. 17, a piece of fabric is fastened to the arch and buttonholes 2 are formed therein to fasten with buttons on the garment 6. Referring to FIG. 16, clasps 4, of the type used on suspenders, can be clipped over the edge 3 of the waistband 10 to releasably hold the arch 4 to the garment 6. Various other releasable connections can be devised given the present disclosure. If desired, a curved pocket defining the shape of the arch could be sewn to the garment 6 and the arch inserted through the pocket and fastened to the belt. The arch and belt could be permanently affixed to the garment, but that may complicate dry-cleaning and pressing the garment. Thus, a removable arch and belt is preferred.

Figure 3:
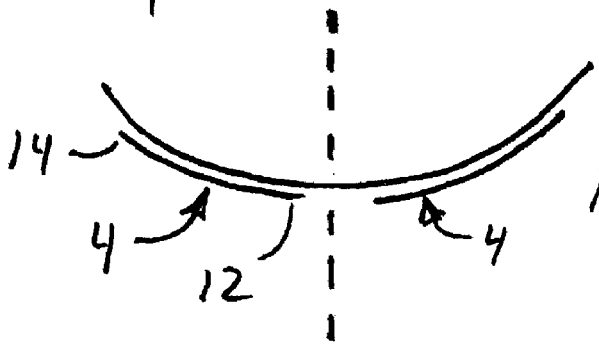
FIG. 3 is a top view of the arches of FIG. 1 conforming to the shape of a stomach.

Referring to FIGS. 3 and 4, the arch 4 is typically not in a flat plane during use, but curves to conform to the shape of a person's stomach. The distal ends 12, 14 of the arch 4 are optionally stronger to provide more vertical stiffness, and the middle portion of the arch 4 is more flexible in order to reduce pressure on the abutting stomach. The arch 4 is thus doubly curved, with a first curvature extending along a person's stomach in a generally horizontal direction to conform to the lateral portion of a person's stomach. The second curve of the arch 4 is along a vertical direction to conform to a person's stomach as it curves from the waistline downward toward a person's crotch. The arch 4 is preferably formed with this double curvature, but could also be formed flexible enough to take this preferred shape during use.

The arch 4 is typically not symmetric about a vertical line, especially when one arch is fastened to the garment 6 using two fasteners 2. The arch 4 is tilted since the front end 12 is lower than the rear end 14, according to the position of the belt 1 to which the arch is fastened. The top of each arch is preferably fairly flat so the arch can be fastened to the horizontal waistband of a garment. Alternatively described, each of the arches 4 preferably fasten to the garment 6 at two locations on the waistband 10, and the curve of the arch between those fastening locations is preferably small enough that the arch does not extend above the waistline 3. The arches 4 are located on the left and right sides of a user, and tilt toward each other or are inclined toward each other as best seen in FIG. 1. The two fasteners 2 that fasten the arch to the garment 6 are preferably in a generally horizontal line, but need not be so. Indeed, the arches 4 can be configured to allow the waistline 3 to be above or below the horizontal. Thus, the belt 1 defines the location of the ends 12, 14 of the arch and the connection 2 with the waistband 10 defines two more locations on the arch 4 for connecting the garment 6 to the arches and hence to the belt.

The connection between the waistband 10 and the arch 4 should be sturdy enough to allow the arch to support the waistband 10 and maintain the waistline 3 in position. Waistbands 10 are commonly formed if folded over material so they have additional thickness and stiffness. Preferably the waistband 10 has sufficient thickness or stiffness so the waistline 3 forms a uniform line and does not rise adjacent the connection with the arch and does not sag away from the connection with the arch. If the waistband 10 is not present, the arch 4 simply fastens directly to the garment 6.

Referring to FIGS. 6-7, the belt 1 optionally has fasteners 2 located at one or more locations along the user's back in order to fasten the belt to the garment 6 around the entire waistline 3 through the waistband 10. Preferably there is a fastener 2 on the rear side of each hip and one in the middle of the back of the garment 6, in order to ensure the belt 4 does not ride up into view if the user bends over, and to hold the belt in place when removing the garment.

Figure 11:
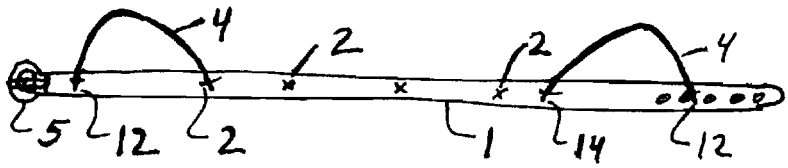
FIG. 11 is a plan view of the belt of FIG. 1.
Figure 12:
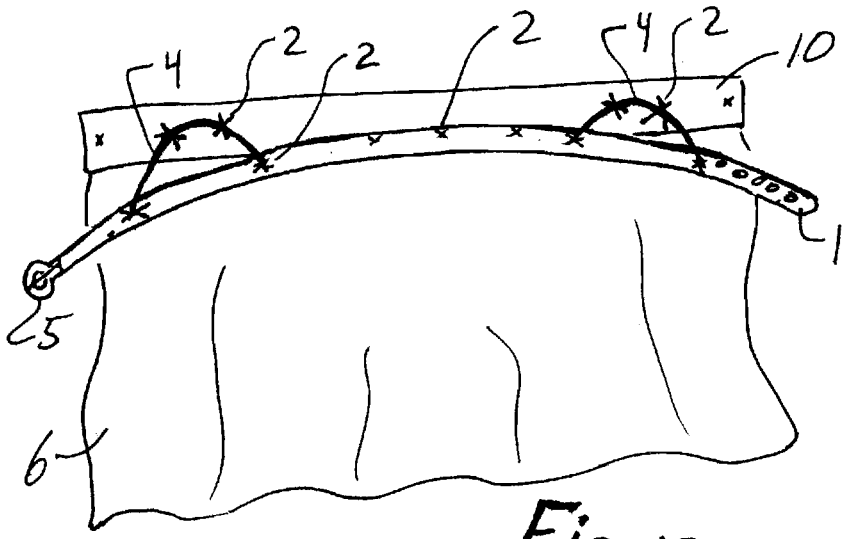
FIG. 12 is a plan view of a belt fastened to a skirt.
Figure 13:
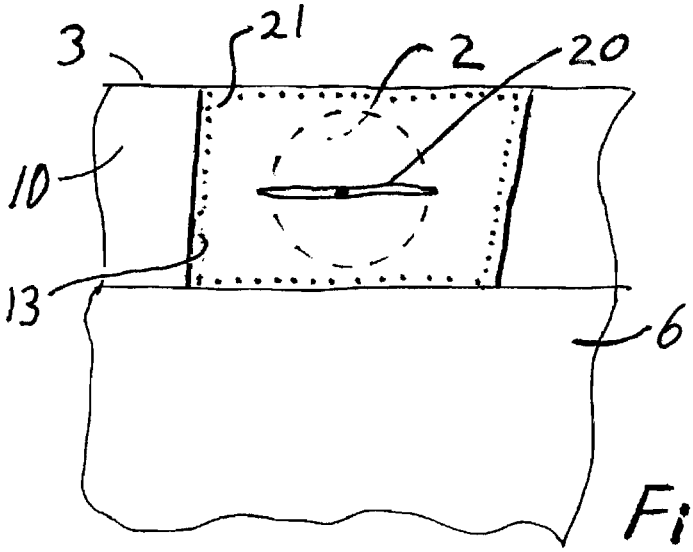
FIG. 13 is a plan view of a portion of a waistband showing a button hole for a fastener.
Figure 14:
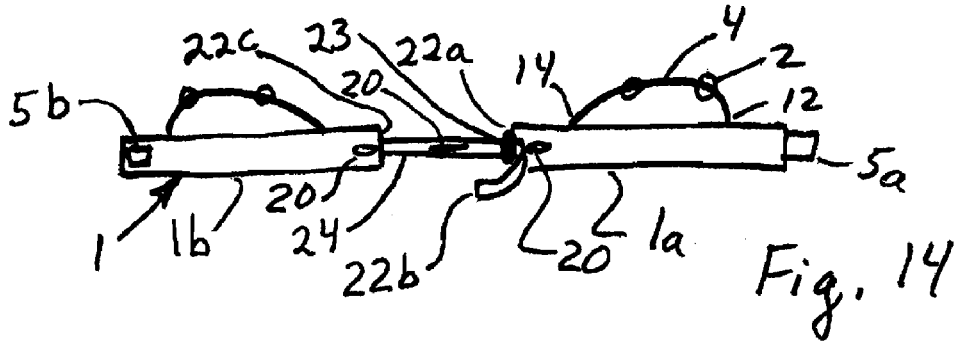
FIG. 14 is a plan view of the inside of the belt of FIG. 1 without a garment.
Figure 15:
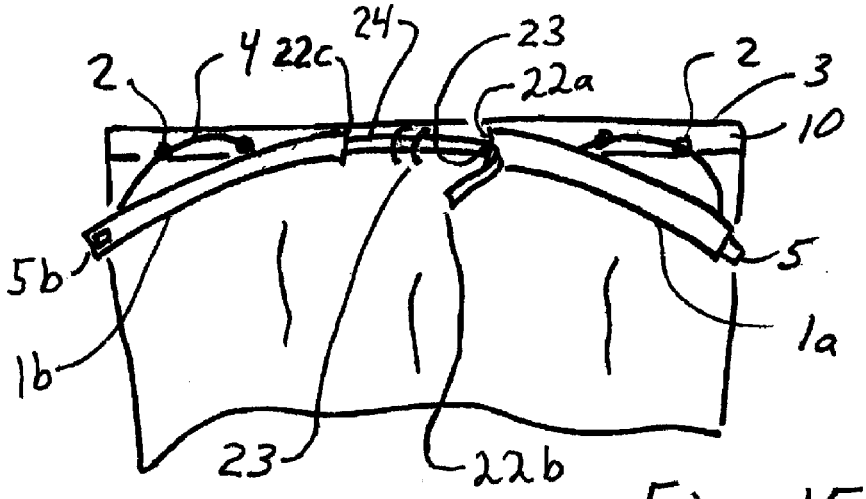
FIG. 15 is a plan view of the inside of the belt of FIG. 1 and the inside of the garment with the garment and belt laid flat.

Referring to FIGS. 5 and 6, the belt 1 can be of conventional configuration as in FIGS. 6 and 11-12, or can have an adjustable back as in FIGS. 5 and 14-15. The conventional configuration belt of FIGS. 6 and 11-12 may have fasteners 2 at various locations to connect to the garment 6 and will have arches 4, but cold otherwise be of conventional construction.

Referring to FIGS. 5 and 14-15, the belt 1 with an adjustable back is shown. The belt comprises two parts, 1*a* and 1*b* so the belt is adjustable adjacent a person's back. The buckle 5 could be a conventional adjustable buckle as in FIG. 5, but is preferably a two part buckle having one projecting part 5*a* the fits into and interlocks with a mating recess in the other part 5*b* as shown in FIGS. 14-15. Each part 1*a*, 1*b* of the belt thus has a portion of the buckle 5*a*, 5*b* on one end, and a joined, adjustable end 22*a*, 22*b* on the opposing end. The adjustable ends 22*a*, 22*b* are adjustably and releasably fastened together using any known mechanism 23. Such adjustable and releasable fastener mechanism 23 include buckles 5, and variations thereof, interlocking tabs with adjustable loops on the ends, a series of prongs and mating holes, and other adjustable fasteners described herein or known to those skilled in the clothing and apparel art.

A belt 1 with an adjustable back allows the location of the front end 12 of the arches 4 to maintain a constant location while the length of the belt is varied. Making the back of the belt 1 adjustable complicates fastening the back portion of the belt to the garment 6. FIG. 15 shows fastener 2 taking the form of one or more internal belt loops 23 fastened to the inside of waistband 10, with the belt threaded through the loops 23. FIG. 14 shows an elongated slit 20 in the belt portion 1*b* which can be passed over a button on the inside of the waistband 10. Mating snaps, toggles, and other fastening devices disclosed herein or known to those skilled in the clothing and apparel art can be used to fasten the belt 1 to the garment 6 along the back of the user and between the user's hips. More than one slit 20 could be used and more than one slit and fastener could be engaged to fasten the garment to the belt.

In use, the belt 1 sits slightly above the user's hips so that it rests on the hips and extends below the user's stomach and follows the juncture of the stomach with the thighs in order to provide a foundation to hold the garment 3 in position using the arches 4. This juncture is well defined when a person sits, and remains definable when a person stands or bends forward. The arches 4 connect to the belt 1 below the hips. The arch 4 spaces the waistline 3 above the user's hips in a generally horizontal position, or along a line considered desirable by the user. The shape and size of the arch 4 is varied according to the size of a person's stomach (e.g., the amount the stomach protrudes) and the desired location of the waistline. The belt 1 and arch 4 combine to provide a positioner 16 (FIG. 5) that holds the waistline 3 in a desired position, using an internal belt 1 that comfortable conforms to the user's natural body formation along the juncture of the thighs and stomach. The positioner 16 inhibits the waistline 3 of the garment 6 from sliding down the stomach, and varying the arch 4 can vary the level of the waistline 3 to a desired location. For persons with a protruding stomach the waistline 3 is often preferred to be horizontal and slightly above the hips. In contrast, some youths may prefer the waistline 3 to be maintained closer to the crotch, whether horizontal or not.

The positioner 16 gives a very comfortable fit around the user's waist. The belt 1 is adjustable using an adjustable strap at the back section of the belt. This allows full adjustments without changing the relative position of the arches with the garment. The belt need not be tightened to compress against the user's stomach. The positioner 16 rests against the outside of a user's shirt to hold the shirttails in place while the waistband 10 rests comfortably around the user's waistline, without squeezing the stomach uncomfortably. As desired, some or all of the arch could be covered with a material that will enhance the shirt holding ability, such as a slightly rough, gripping material that will more readily cling to the shirt. A construction using a metal arch covered with fabric such as thick cotton or polyester. A curved metal rod of uniform cross section is believed suitable, with a circular cross-section being preferred for such a curved member. One or more of the flexible arch 4, flexible belt 1, or the rotatable connection 2 with the belt 1, allow comfortable movement in any direction without binding or squeezing the user's stomach.

Different sized and shaped arches may be to adjust for a person's waistline and stomach size, and also to adjust somewhat for a person's height. Because the arch is fastened at only a few locations, removal and replacement is easily achieved. The positioner 16 is light and does not put pressure on the user's body, and the small amount of pressure that is applied is applied along the naturally occurring fold lines between a person's thighs and stomach. Indeed, as a person sits down, the thighs and stomach may clamp the positioner 16 in place. The positioner 16 is opened only when the garment is opened or removed. The positioner 16 is opened by disconnecting the distal ends of the belt 1, typically by unbuckling buckle 5 located between the arches 4. Opening the positioner 16 is useful to undo a zipper down the front of a pair of pants. But if the garment has no front zipper as in some ladies' skirts, then the belt may be made so it does not open.

If desired, the arch 4 could be provided with tabs to make it easier to connect the garment 6 to the arch using fasteners 2. For example, as seen in FIG. 9, a tab 18 could have a buttonhole in it to allow a button on the inside of the waistband 10 of garment 6 to fasten to the tab 18 and arch 4. Again, other releasable connectors could be used with removable arches 4, such as snaps, toggles, hook-and-loop, etc.

The above description uses two arches 4, but more arches could be used. For most normally sized persons, two arches 4 are sufficient.

As best seen in FIGS. 1, 5-6 and 11, a special belt 1 is used which has a front end 12 of a first arch 4 fastened at or very near to the buckle 5, or other releasable connector. The other, tail end of the belt 1 typically has the front end 12 of the second arch 4 fastened at a greater distance from the end of the belt because the belt is adjustable. The belt 1 may have releasable fasteners 2 at various locations along the length of the belt to allow the position of the arches 4 to be varied. The belt 1 may have the arches 4 permanently fastened to the belt. Rivets, stitches, etc. are among the various ways to permanently fasten the arches to the belt. The belt may be a two-piece belt with an adjustable back (FIGS. 5 and 14-15).

Referring to FIGS. 1, 7, 12 and 15, the garment 6 preferably has a waistband 10 stiff enough to support the waistline in a desired position, which is typically level or horizontal, when connected to each of the arches 4 at the desired number of locations, typically at one or two locations per arch. The garment 6 also preferably has fasteners 2 at locations that correspond to the middle of the user's back and rearward of the hips to ensure the belt 1 does not ride up above the waistline 1. The garment 6 has fasteners 2 at locations corresponding to the position of the arches 4. The garment 6 can be pants, skirts, dresses, or other garments work over the lower portion of the body that are fastened around the user's waist. The arches 4 are preferably removably fastened to the garment 6 using fasteners 2, but the arches could be permanently fastened to the garment, in which case the arches could be either removably fastened to the belt 1 at ends 12, 14, or the arches could be permanently fastened to the belt. Thus, the belt 1 and arches 4 could be permanently fastened to the garment. For custom tailored clothing, the belt 1 could have a fixed length and be fastened permanently to the clothing.

The arch 4 is preferably a continuously curved, flexible member. The arch 4 could be made in straight line segments, but that is not preferred because the corners are likely to press noticeably against the user's stomach and the corners are likely to kink and break. The arches 4 are thus preferably continuously curved between the connections to the belt 1, without any sharp corners. The rear ends 14 on the left and right arches 4 preferably fasten to the belt 1 near the user's hips, and preferably just in front of the user's hips. The front ends 12 on the left and right arches 4 preferably fasten to the belt above the user's crotch, and advantageously high enough above the crotch that a male user could urinate without undoing the belt 1. While the specific dimensions and locations of the arches 4 will vary with a person's stomach and physique, for many people the top of the arches will be about 4-6 inches away from the center plane of a person's body, where the plane extends from the front to the back through the middle of a person's body. The front end 12 for many users will be located about two inches from that center plane. Preferably, looking at the face and front body of an adult person wearing the belt 1, the distance between the front ends 12 of the two adjacent arches is about four inches and the distance between the fasteners 2 on the each of the front ends 12 of the arches 4 is about seven inches.

Referring to FIGS. 12-13, 15 and 17, the arches 4 are preferably, but optionally fastened to the garment 6 by buttons 2 placed into a pocket in the waistband 10 through a generally horizontal slit 20. The slits 20 are advantageously formed in a piece of material 21 (FIG. 13) which is then fastened to the waistband 10, preferably by sewing or clipping it to the waistband. That allows the slit 20 to take the form of a reinforced buttonhole with the piece of material containing the buttonhole forming a pocket between the piece of material and the waistband 10 with the button 2 received and held in that pocket. The buttons 2 are preferably, but optionally, about as large in diameter as the width of the waistband 10 so that the buttons help hold the entire width of the waistband in position to reduce sagging between the various connections to the belt 1. The horizontal slit 20 (FIG. 13) allows the fastener 2 to move laterally along the waistband 10 to accommodate movement of the user while still supporting the waistband 10 and waistline 3 through the arch 4 connected to the button 2. About 0.5 inches of lateral movement of fasteners 2 that connect the arches to the garment 6, is believed suitable for most uses. A piece of stiffer material 21, such as a plastic part with rounded corners could be permanently placed in the waistband, with a snap to releasably connect to the arch, and with a slit 20 to allow movement of the snap and plastic insert along the waistband. Indeed, a snap fastener at the center of the depicted button 2 that is accessible through slit 20 would provide such a connection. Other movable and releasable fasteners 2 can be devised given the present disclosure, including passing the belt 1 through loops 2 as in FIG. 15.

There is thus provided means comprising a positioner 16 comprising a belt 1 with a two flexible offsets 4 located near opposing distal ends of the belt, and fasteners 2 that fasten the garment 6 to the arch inside the garment for supporting the waistline 3 of the garment at a normal level while that waistline is offset from the belt by the arches 4.

Referring to FIGS. 4 and 17, a preferred construction is shown having a flexible belt 1 of a relatively thick woven fabric, of the type used on "Army belts." This thicker, woven fabric is relatively flexible, or at least it deforms more readily if a constant deformation force is applied as by the distal end of the arch 4. The thick woven fabric of belt 1 provides a cushion against the body of the user. The arch 4 is optionally enclosed in fabric, such as thick cotton stitched around the metallic arch, with the ends 12, 14 of the arch inserted into pockets formed by a strip of material 24*a* forming a little pocket 26 that receives one end of the arch. A short strip of nylon is suitable for the material 24*a*. The strip of material 24*a* is fastened to the belt by stitches 13, but could be riveted, glued, or fastened by other ways described herein or known to one skilled in the clothing and apparel art.

Referring to FIG. 17, a strip of material 28 is sewn to opposing legs of the arch 4 and fasteners 2 are connected to or formed in that piece of material. In the illustrated embodiment button holes 2 are provided and located to fasten to mating buttons on the inside of the waistband 10 of the garment 6. Again, various fasteners can be connected to the material 26 as described herein or as known to a person skilled in the clothing and apparel art. Further, while FIG. 17 shows both buttons 2 connected to the arch 4 and button holes 2 connected to the material 26, both are considered connected to the arch 4 and one or the other could be provided, or both could be provided, or any combination thereof.

Preferably, but optionally, the material 24*a* forms an elongated strip 24 that extends along the entire length of belt 1. In FIGS. 14-15, the elongated strip of material 24 can form part of belt portion 1*b* which threads through a clasp to form an adjustable portion at the back of the user, or in the middle of the belt. In this configuration the elongated strip of 24 is of Nylon and is less stretchable than the woven material of underlying belt portion 1. There is thus provided a belt 1 having two portions 1*a*, 1*b* joined at a middle of the belt. Each belt portion 1*a*, 1*b* has an arch 4 fastened thereto. Each belt portion 1*a*, 1*b* preferably, but optionally, has a softer portion 1 located on the side of the belt toward the user and a strengthening portion 24 located on the side of the belt away from the user. The elongated strengthening portion 24 can form a portion of the connection between ends 22*a*, 22*b* of the belt.

Still referring to FIG. 17, the material 24 locally stiffens the segment of the belt 1 that holds the ends of the arch 4. The arch 4 can flex in along the vertical Y axis as a person bends forward against the arch, and the apex of the arch between the buttons 2 can move relative to the belt 1 which remains stable. Further, as a person bends forward the arch 4 can rotate about the X axis at the juncture of the arch 4 with the belt 1 so the apex of the arch moves in and out of the X-Y plane while the ends of the arch remain stable at the belt, as partially shown in FIG. 4. Likewise, the ends of the arch 4 can move along the Z axis relative to the apex of the arch between the buttons 2 in order to curve around a user's stomach as shown in FIG. 3.

The strips 24 fastened to the belt 1 at the ends of the arch 4 provide a stable base for the arch 4, allowing the arch to rotate and deform while the ends of the arch remain in essentially the same location, but may rotate as the arch tilts or deforms. The connection of the ends of the arch 4 to the belt 1 thus restrains translation of the two opposing ends of the arch relative to the belt 1, but permits rotation in at least the Z axis so the arch apex can rotate.

The forces on the arch 4 are believed to come from two main sources, the first being the weight of the garment 6 passing through the fasteners 2 to the arch 4 and through the arch to the belt 1 and thus to the user. The second source of forces is believed to be the force exerted by the user's body on the arch 4, and that force is believed to primarily come from the user's stomach, with the force varying depending with movement of the stomach, as for example when the user bends forward, sideways or backwards.

The connection of the ends of the arches 4 to the belt 1 also cushion the forces exerted on each arch and pass those forces along a length of the belt placed along the creases or junctures between the user's thighs and stomach. Since the force exerted on the arches 4 is diffused along a relatively long length of the belt, the force is less, the smaller force is less noticeable and the user's comfort is increased. Moreover, as the user moves the belt 1 does not tighten with movement of the user's stomach as in the prior art because the belt 1 rests against the body creases at the juncture of the stomach and thighs, and also rests on the user's hips. Further, it is believed that as the size of a user's stomach increases and protrudes more, the belt begins to be squeezed or clamped between the user's thighs and stomach, and this squeezing or clamping of the belt 1 further distributes any force from the arches 4 and belt 1 over a greater area, further lessening the force and increasing the perceived comfort.

Thus, when the arch 4 is described as flexible in the vertical direction, the flexibility refers to the ability of the arch 4 to move as described when fastened to the belt 1. When the arch 4 is described as rotating about the length of the belt 1, the rotation refers to the ability of the arch 4 to rotate about the X axis (FIG. 17) as described when the ends of the arch are fastened to the belt 1.

In a preferred embodiment, the ends of the arches can be pulled out of the pockets 26 formed in the belt 1 by strips of material 24. If the garment 6 is provided with belt loops on the inside of the garment on opposing sides of the crotch or zipper, the user could thread the buckle parts 5*a*, 5*b* through these loops and use the belt 1 as an internal, concealed belt. This could be useful when the user is to remain seated for long periods of time, as on transcontinental flights which can last from 10-15 hours, or more.

The belt 1 is greatly preferred to be worn inside the garment 6 and concealed from view during use. But the belt 1 could be worn outside the garment 6. Moreover, while the belt 1 maintains the position of the garment waistline 3 at the desired location (horizontal or otherwise). Further, even though an internal belt 1 maintains the waistline 3 and supports the garment 6 on the user's body, external belt loops and an external belt can be used in order to maintain conventional appearances. Indeed, a user with a pronounced stomach but wearing an external belt at a horizontal position maintained by internal, concealed belt 1 and arches 4, is believed to appear thinner than the user actually is. If an external belt is used, it is preferably, but optionally, thin, slightly elastic and light weight.

The belt 1 and arches 4 thus provide means for maintaining the waistline 3 of a garment 6 in a desired location on a user's body. The arches 4 provide means for varying the position of the waistline 3 relative to the belt 1. The adjustable buckle 5 accommodates variations in waist size. The adjustable rear portions 22*a*, 22*b* joined by the releasable mechanism or buckle 23 also accommodate variations in waist size but without altering the relative position of the arches 4. The various mechanisms such as buckles 5, 23 provide adjustable means for joining ends of the belt 1.

The belt 1 provides a very comfortable way to support the garment 6 while maintaining the waistline 3 at a desired location. The belt 3 is preferably lightweight, weighing about ⅓ the weight of a leather belt of comparable width.

Figure 19:
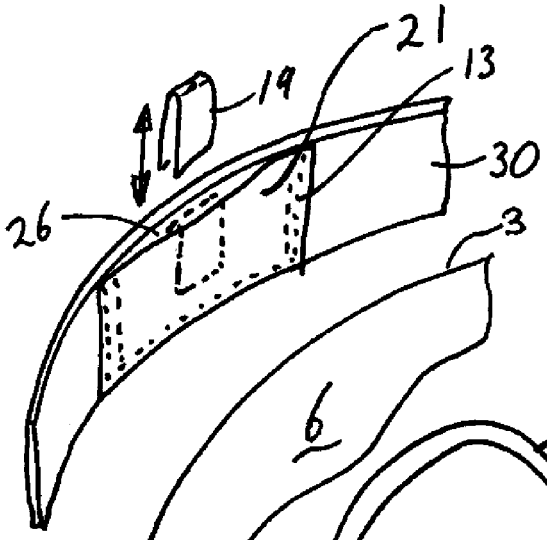
FIG. 19 is a sectional view showing the external belt and garment of FIG. 18 fastened to the arch on the belt of FIG. 1.
Figure 19:
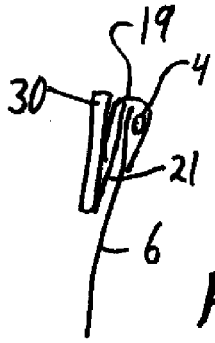
Figure 18:
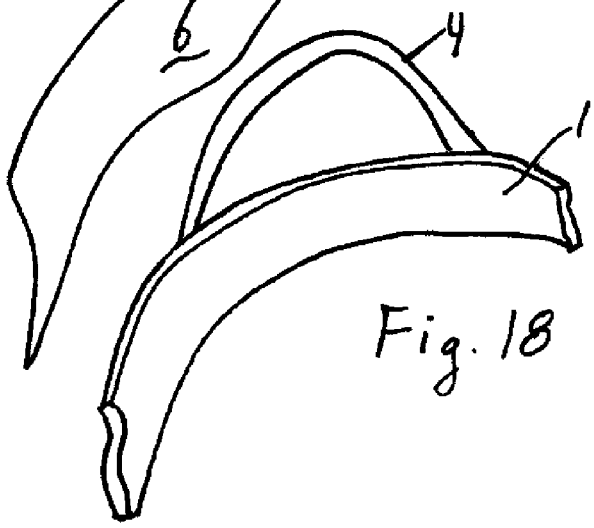
FIG. 18 is a partial perspective view of an external belt fastened to a garment and optionally fastened to the arch and belt of FIG. 1.

Referring to FIGS. 18-19, the belt 1 is preferably inside the garment 6 and not normally visible to others. A normal belt 30 can be worn outside the garment 6 to give the appearance of a normal belt and garment. If belt loops are provided in the garment the belt 30 will be held by those loops. But it is advantageous to keep the belt level with the waistline 3 of the garment 6. To do so, a piece of material 21 can be fastened to the belt 30, preferably on the inside of the belt, to form a pocket 26. Stitches 13 are preferably used to fasten the material 21 to the belt 30, but rivets, adhesives or other fastening mechanisms could be used. The piece of material 21 is preferably fastened to the belt 30 along three sides, around the opposing ends and bottom but not at the top, so an open pocket 26 is formed on the inside of the belt 30. A clasp 19 can fit inside the pocket 26 to clamp the pocket (and thus the belt 30) to the garment 6, thus maintaining the belt 30 in alignment with the waistline 3 of the garment. Instead of a clasp 19, the piece of material 21 fastened to the external belt 30 could have a buttonhole as described in FIG. 13, so that a button fastened to the waistband on the outside of the garment 6 could be fastened to the external belt 30. By forming a pocket 26 on the inside of the belt 30, the pocket and clasp 19 are concealed from view, although a top portion of the clasp may be visible. A button connecting the garment to the pocket 26 formed by piece of material 21 would be concealed from view. There is also provided a means for fastening an external belt 30 to the garment 6 to maintain the belt 30 in a desired alignment with the waistline 3 of the garment.

Further, the arch 4 could also be held by the clasp 19 in order to fasten the interior belt 1 to the garment 6, as shown in FIG. 19. There is thus provided further means for fastening the belt 1 to the garment.

Referring to FIG. 15, the belt 1 is preferably fastened to the garment 6 at a location along the user's back by passing the strip of material 24 through belt loops 23, although any known ways of releasably fastening the parts can be used. But as seen in the figure the wide portion of belt 1 has an end 22*c*. Ends 22*a*, 22*c* could be fastened directly to the garment 6, by buttons, snaps, toggles, or other releasable connections. Thus, button holes 20 are shown in FIG. 14 in the ends 22*a*, 22*c*, for fastening with aligned buttons (not shown) on the garment 6. Further, the ends 22*a*, 22*c* could be permanently fastened to the garment 6, as for example by sewing or rivets or other fastening mechanisms used in the apparel industry.

As seen in FIGS. 2, 6, 7, 10-12 and 18, the arch 4 is curved such that the radii of curvature of the arch are always on the same side of the arch. As viewed in these figures, the radius of curvature of any point on the arch 4 is on the same (lower) side of the arch. Moreover, as reflected in part by the non-circular shape of the arch cross-section shown in FIG. 19, the arch 4 can have a vertical width and a horizontal thickness, with the vertical width being greater than the horizontal thickness as viewed in that Figure. The arch 4 has sufficient stiffness or wide along the vertical or height direction of the person using the belt 1 to support a portion of the weight of the garment 6 above the belt 1 during use. The arch 4 has sufficient thickness along a direction perpendicular to the width and toward and away from the body of the person abutting the belt 1 during use so that the arch 4 can flex as the person moves during use. The arch 4 flexes more easily in the horizontal thickness direction than in the vertical width direction. The arch 4 is self-supporting as it supports its own weight, and a portion of the weight of the garment attached to the arch.

The above description is given by way of example, and not limitation. Given the above disclosure, one skilled in the art could devise variations that are within the scope and spirit of the invention disclosed herein, including various ways of configuring and locating the fasteners 2 and the arches 4 and a variety of connectors 2 could be used. Likewise, a variety of adjustable connectors 5, 23 could be used for connecting the ends of the belt 1 or belt portions 1*a*, 1*b*. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A belt for holding a garment on a person, comprising:

a belt configured to abut the person along a natural curve of the person's body between the person's stomach and upper thighs during use of the belt;

first and second arches, each having a front end a rear end and fastened to the belt only at and adjacent to at the front and rear ends of the arch, with the front end of each arch fastened adjacent a different end of the belt, the front end of each arch located so it fastens to the belt at or adjacent to the person's crotch during use, the rear end located so it fastens to the belt at or just in front of the hips of the person during use such that the front end of the arch is lower than the rear end of the arch during use, each arch, between the ends of the arch that are fastened to the belt, being continuously curved and having no sharp corners, the arches being made of metal or plastic, each arch configured to support a waistline of the garment above the belt when the weight of the garment urges the arch toward the belt;

at least two first fasteners connected to each of the arches between the front and rear ends and adjacent a top of the arch.

2. The belt of claim 1, wherein each of the first and second arches are not symmetric, but are inclined toward the other of the first or second arch and connected to the belt to allow rotation about a length of the belt at a juncture of the belt with the ends of the arches.

3. The belt of claim 1, wherein each arch is sufficiently flexible to curve about two axes and conform to a general shape of an extending stomach.

4. The belt of claim 1, wherein the belt has two portions connected by an adjustable length connector located at the back of the person during use of the belt, the adjustable length connector comprising a releasable fastener mechanism permitting complete separation of the two portions.

5. The belt of claim 1, wherein the arches are permanently fastened to the belt.

6. The belt of claim 1, wherein the front and back ends of the arch are stiffer than a portion of the arch between those front and back ends.

7. The belt of claim 1, wherein the fasteners are releasable fasteners.

8. The belt of claim 1, wherein each arch comprises a metal strip covered with fabric.

9. The belt of claim 1, wherein each arch comprises a continuous member without any sharp corners and having sufficient flexibility in a general plane of the belt and arch to resiliently deform in that plane when the person bends over yet sufficient stiffness to maintain a position of a garment fastened to the arches at a waistline of the person after the person bends over and deforms the arch during use, the arch having sufficient flexibility to resiliently deform about two axes to conform to the shape of the person's stomach, the ends of the arch being fastened to the belt but permitting the arch to move toward and away from the belt and the plane as the person bends over during use of the belt.

10. The belt of claim 1, wherein the arch has a width and a thickness, with the width being greater than the thickness.

11. The belt of claim 1, wherein the arch has a width in the direction along a height of the person using the belt, the arch having a thickness along a direction perpendicular to the width and toward and away from the body of the person abutting the belt during use, and wherein the arch flexes more easily in a thickness direction than in a width direction.

12. The belt of claim 1, wherein the arch has sufficient width along a direction of the person's height to maintain the garment at the waistline during use, the arch having a thickness smaller than a width and providing sufficient flexibility to return to its shape as the person bends over and unbends during use of the belt.

13. The belt of claim 1, wherein the arches by themselves have sufficient strength to support a waistline of the garment above the belt at a predetermined position during use of the belt without suspending the arches from something else.

14. The belt of claim 1, wherein the belt is not configured to provide a connection with the garment at the front of the person, between the first and second arches, during use of the belt.

15. A belt for holding a garment on a person, the belt having opposing distal ends, comprising:

first and second curved arches made of metal or plastic, each arch having a front end a rear end, the arches fastened to the belt only at and adjacent to the front and rear ends of the arch, with the front end of each arch fastened adjacent a different end of the belt, the front end of each arch located so it fastens to the belt below the person's stomach and at or near the person's crotch during use, the rear end located so it fastens to the belt at or just in front of the hips of the person during use, the rear end being located hider than the front end during use, the arches being continuously curved and having no sharp corners;

at least two first fasteners connected to each of the arches between the front and rear ends and adjacent a top of the arch, the arches supporting the weight of the garment during use and to holding a waistline of that garment above the belt when the garment is fastened to the arches using the at least two fasteners so the weight of the garment pulls the arches toward the belt during use of the belt and without connecting the arch to another garment for support.

16. The belt of claim 15, wherein the arch is curved with a radii of curvature located on only one side of the arch when the belt is not in use.

17. The belt of claim 15, wherein each arch is sufficiently flexible to curve about two axes and conform to the general shape of an extending stomach without permanently deforming.

18. The belt of claim 15, wherein each arch joins the belt at an inclined angle relative to a longitudinal axis along a length of the belt.

19. The belt of claim 15, wherein the end of each arch is fastened to the belt but allowed to rotate away from a plane of the belt at a juncture of the belt and the end of the arch.

20. The belt of claim 15, wherein the arch has a portion with less curvature at a location where the fasteners are connected to the arch, during use of the belt than the curvature adjacent the front end of the arch.

21. The belt of claim 15, wherein a first portion of each arch on a front side of the fasteners is inclined downward toward the crotch and a second portion of each arch on a back side of the fasteners extends along a length of the belt toward the person's hip during use.

22. The belt of claim 15, wherein the belt comprises two non-elastic parts each having one of said distal ends and each having a second belt end, with a mechanism at the front of the belt to join the distal ends of the belt parts and an adjustable length connector located at the back of the person during use of the belt, the adjustable length connector being fastened to one of the second belt ends and releasably connected to the other second belt end to join the second ends of the belt parts.

23. The belt of claim 15, wherein each arch comprises a metal strip covered with fabric.

24. A belt for holding a garment on a person having a stomach and a fold line along the juncture between the stomach and thighs, comprising:

a belt comprising an elongated member separate from the garment and having two parts, each part having a front belt end and a back belt end, the front belt ends having a releasable front connector to releasably connect the front belt ends at the front of the person during use, the back belt ends having a releasable back connector to releasably connect the back belt ends at a location along the person's back during use of the belt with the releasable back connector being adjustable to vary the length between the back belt ends of the belt parts, the belt having a length selected to fit along the fold line when the front and back belt parts are both connected;

first and second self-supporting arches, each arch having a front end fastened adjacent a different front end of the belt, each arch having a rear end located so it fastens to the belt at or just in front of the hips of the person during use, the arch being continuously curved and made of metal or plastic, each arch configured to support a waistline of the garment above the belt when the weight of the garment urges the top of the arch toward the belt during use;

at least two first fasteners connected to each arch between the front and rear ends of each arch and adjacent a top of the arch which is adjacent the waistline of the garment during use configured to fasten the arch to the garment during use.

25. The belt of claim 24, wherein the top of the arch is generally horizontal with a length sufficient to allow the at least two fasteners to be separated along the waistband during use.

26. The belt of claim 24, wherein the adjustable connector at the back of the belt adjusts for waist size while not altering the distance between the two arches measured at the front of the belt.

27. The belt of claim 24, wherein the top of the arch is generally horizontal during use of the belt to support the garment.

28. The belt of claim 24, wherein each end of the arch is inserted into a pocket fastened to the belt, which pocket restrains only downward motion of the end of the arch in the pocket.

29. The belt of claim 24, wherein there is no arch on the back of the belt.

* * * * *